US011062669B2

(12) United States Patent
Dai et al.

(10) Patent No.: US 11,062,669 B2
(45) Date of Patent: Jul. 13, 2021

(54) DRIVING CIRCUIT AND DRIVING METHOD FOR LIQUID CRYSTAL DISPLAY PANEL, AND DISPLAY DEVICE

(71) Applicants: HEFEI BOE DISPLAY TECHNOLOGY CO., LTD., Anhui (CN); BOE Technology Group Co., Ltd., Beijing (CN)

(72) Inventors: Ke Dai, Beijing (CN); Yunyun Liang, Beijing (CN); Liugang Zhou, Beijing (CN); Zhenlin Qu, Beijing (CN); Liu He, Beijing (CN); Qing Li, Beijing (CN); Jun Wang, Beijing (CN); Yu Quan, Beijing (CN); Xiaofeng Yin, Beijing (CN); Liwei Zhou, Beijing (CN); Lin Zhang, Beijing (CN); Tao Li, Beijing (CN); Yulong Xiong, Beijing (CN)

(73) Assignees: HEFEI BOE DISPLAY TECHNOLOGY CO., LTD., Hefei (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/994,891

(22) Filed: Aug. 17, 2020

(65) Prior Publication Data

US 2021/0097950 A1 Apr. 1, 2021

(30) Foreign Application Priority Data

Sep. 30, 2019 (CN) ..... 201910938799.1

(51) Int. Cl.
*G09G 3/36* (2006.01)
*G09G 3/34* (2006.01)

(52) U.S. Cl.
CPC ..... *G09G 3/3677* (2013.01); *G09G 3/3406* (2013.01); *G09G 2310/0286* (2013.01); *G09G 2310/08* (2013.01); *G09G 2320/0233* (2013.01); *G09G 2320/064* (2013.01); *G09G 2320/0646* (2013.01)

(58) Field of Classification Search
None
See application file for complete search history.

(56) References Cited

U.S. PATENT DOCUMENTS 9,070,318 B2 * 6/2015 Hwang ..... G09G 5/12
2006/0007106 A1 * 1/2006 Oh ..... G09G 3/3406 345/102

(Continued)

*Primary Examiner* — Dorothy Harris
(74) *Attorney, Agent, or Firm* — Arent Fox LLP; Michael Fainberg

(57) ABSTRACT

The present disclosure provides a driving circuit and driving method for a liquid crystal display panel, and a display device. The driving circuit includes: a signal collector, configured to collect a backlight control signal; and a timing control chip, configured to determine whether a BLU is in the bright state time period or in the dark state time period, and retrieve a first gate control signal from a memory chip and output the first gate control signal to a gate driving circuit, when determining that the BLU is in the bright state time period, or retrieve a second gate control signal from the memory chip and output the second gate control signal to the gate driving circuit, when determining that the BLU is in the dark state time period.

10 Claims, 5 Drawing Sheets

(56) References Cited

U.S. PATENT DOCUMENTS

| | | | | |
|---|---|---|---|---|
| 2011/0141002 | A1* | 6/2011 | Kim | G09G 3/342<br>345/102 |
| 2014/0085354 | A1* | 3/2014 | Hwang | G09G 5/12<br>345/691 |

* cited by examiner

DRIVING CIRCUIT AND DRIVING METHOD FOR LIQUID CRYSTAL DISPLAY PANEL, AND DISPLAY DEVICE

The present application claims the priority from Chinese Patent Application No. 201910938799.1, filed with the Chinese Patent Office on Sep. 30, 2019, and entitled "DRIVING CIRCUIT AND DRIVING METHOD FOR LIQUID CRYSTAL DISPLAY PANEL, AND DISPLAY DEVICE", which is hereby incorporated by reference in its entirety.

FIELD

The present disclosure relates to the field of display technology, in particular to a driving circuit and driving method for a liquid crystal display panel, and a display device.

BACKGROUND

With rapid development in the field of display panels, the demand of people for large-size and high-resolution display panels is increasing day by day, and the requirements on the display effect of display panel products are becoming higher and higher. With the improvement of the size and resolution of the display panels, the display panel process is facing challenges.

SUMMARY

The present disclosure provides a driving circuit and driving method for a liquid crystal display panel, and a display device. In a first aspect, an embodiment of the present disclosure provides a driving circuit for a liquid crystal display panel, including:

a signal collector, configured to collect a backlight control signal;

a memory chip, configured to store a first gate control signal and a second gate control signal; and a timing control chip, configured to:

determine whether a back light unit (BLU) is in a bright state time period or in a dark state time period according to the backlight control signal; and when determining that the BLU in the bright state time period, retrieve the first gate control signal stored in the memory chip, and output the first gate control signal to a gate driving circuit, for controlling pixels in the liquid crystal display panel to be charged for a first duration according to the first gate control signal;

when determining that the BLU is in the dark state time period, retrieve the second gate control signal stored in the memory chip, and output the second gate control signal to the gate driving circuit, for controlling the pixels in the liquid crystal display panel to be charged for a second duration according to the second gate control signal; wherein the second duration is shorter than the first duration.

In some embodiments, the signal collector is configured to:

convert a valid pulse signal, for controlling the BLU to be in a bright state, in the backlight control signal into a high level signal;

convert an invalid signal, for controlling the BLU to be in a dark state, in the backlight control signal into a low level signal;

the timing control chip is configured to:

retrieve a part, corresponding to the high level signal, in the first gate control signal stored in the memory chip when it is determined that the high level signal transmitted by the signal collector is received; and retrieve a part, corresponding to the low level signal, in the second gate control signal stored in the memory chip when it is determined that the low level signal transmitted by the signal collector is received.

In some embodiments, the first gate control signal includes a first set of clock signals, and the second gate control signal includes a second set of clock signals;

a signal cycle duration of the first set of clock signals is the same as a signal cycle duration of the second set of clock signals; and in a signal cycle, a valid pulse duration of the first set of clock signals is longer than a valid pulse duration of the second set of clock signals.

In some embodiments, in parts, in the same signal cycle as the backlight control signal, of the first set of clock signals and the second set of clock signals, a falling edge of the first set of clock signals occurs behind a falling edge of the second set of clock signals.

In some embodiments, the driving circuit according to any one of the above further includes the gate driving circuit, wherein the gate driving circuit includes a plurality of cascaded shifting registers;

the shifting registers are configured to output a first gate scanning signal when receiving the first gate control signal, and output a second gate scanning signal when receiving the second gate control signal; and a valid pulse duration of the first gate scanning signal is longer than a valid pulse duration of the second gate scanning signal.

In a second aspect, an embodiment of the present disclosure provides a driving device, including the liquid crystal display panel, the BLU, and the driving circuit according to any one of the above.

In some embodiments, the gate driving circuit in the driving circuit is integrated in the liquid crystal display panel.

In a third aspect, an embodiment of the present disclosure provides a driving method for a liquid crystal display panel, including:

collecting a backlight control signal;

determining whether a BLU is in a bright state time period or in a dark state time period according to the backlight control signal; and when it is determined that the BLU is in the bright state time period, selecting a first gate control signal pre-stored corresponding to the bright state time period and outputting the first gate control signal to a gate driving circuit, for controlling pixels in the liquid crystal display panel to be charged for a first duration according to the first gate control signal;

when it is determined that the BLU is in the dark state time period, selecting a second gate control signal pre-stored corresponding to the dark state time period and outputting the second gate control signal to the gate driving circuit, for controlling the pixels in the liquid crystal display panel to be charged for a second duration according to the second gate control signal, wherein the second duration is shorter than the first duration.

In some embodiments, after collecting the backlight control signal, the driving method further includes: converting a valid pulse signal in the backlight control signal into a high level signal, and converting an invalid pulse signal in the backlight control signal into a low level signal;

wherein said determining whether the BLU is in the bright state time period or in the dark state time period according to the backlight control signal includes:

when determining that the high level signal is received, determining that the BLU is in the bright state time period;

when determining that the low level signal is received, determining that the BLU is in the dark state time period.

In some embodiments, the first gate control signal includes a first set of clock signals, and the second gate control signal includes a second set of clock signals;

a signal cycle duration of the first set of clock signals is the same as a signal cycle duration of the second set of clock signals; and in a signal cycle, a valid pulse duration of the first set of clock signals is longer than a valid pulse duration of the second set of clock signals.

In some embodiments, in parts, in the same signal cycle as the backlight control signal, of the first set of clock signals and the second set of clock signals, a falling edge of the first set of clock signals occurs behind a falling edge of the second set of clock signals.

BRIEF DESCRIPTION OF THE DRAWINGS

In order to illustrate the technical solutions in the embodiments of the present disclosure more clearly, the drawings required in the description of the embodiments will be briefly introduced below. Obviously, the drawings in the following description are merely some embodiments of the present disclosure, and for those of ordinary skill in the art, other drawings can also be obtained based on these drawings without inventive efforts.

DETAILED DESCRIPTION OF THE EMBODIMENTS

In order to make the objectives, technical solutions and beneficial effects of the present disclosure clearer and more explicit, the technical solutions in the embodiments of the present disclosure will be clearly and completely described below in conjunction with the accompanying drawings in the embodiments of the present disclosure. Apparently, the embodiments described are merely part of the embodiments of the present disclosure, rather than all of them. All other embodiments obtained by those of ordinary skill in the art based on the embodiments in the present disclosure without creative efforts should fall within the protection scope of the present disclosure.

The application scenarios described in embodiments of the present disclosure are for the sake of illustrating the technical solutions in the embodiments of the present disclosure more clearly, rather than constituting limitations to the technical solutions provided by the embodiments of the present disclosure. It can be known by those of ordinary skill in the art that with the emergence of new application scenarios, the technical solutions provided by the embodiments of the present disclosure are also applicable to similar technical problems.

The words "a/the plurality of" mentioned herein refer to two or more. The words "and/or" describe the relationship of related objects, indicating that there may be three relationships, for example, A and/or B, indicating that there are three conditions: only A exists, A and B exist at the same time, and only B exists. The character "/" generally indicates that the preceding and later related objects are in an "or" relationship.

At present, the development in the field of display panel technology is rapid, the demand of users for large-size and high-resolution display panels is increasing day by day, and the requirements on the display effect of display panel products are becoming higher and higher. At present, most of the backlight systems of complete TVs control the brightness by using pulse width modulation (PWM). A BLU switches between high and low levels according to a certain frequency and duty cycle, and controls the backlight brightness by adjusting the duty ratio. The backlight brightness cannot be recognized by human eyes due to the high frequency. However, in the backlight bright and dark states, the presence or absence of light affects the conductor characteristics of an Array Active layer, so that RC Delays of Data voltages are different, and fringes with different brightness are generated on the panel, called bad waterfall, which affects the display effect of images.

Figure 1:
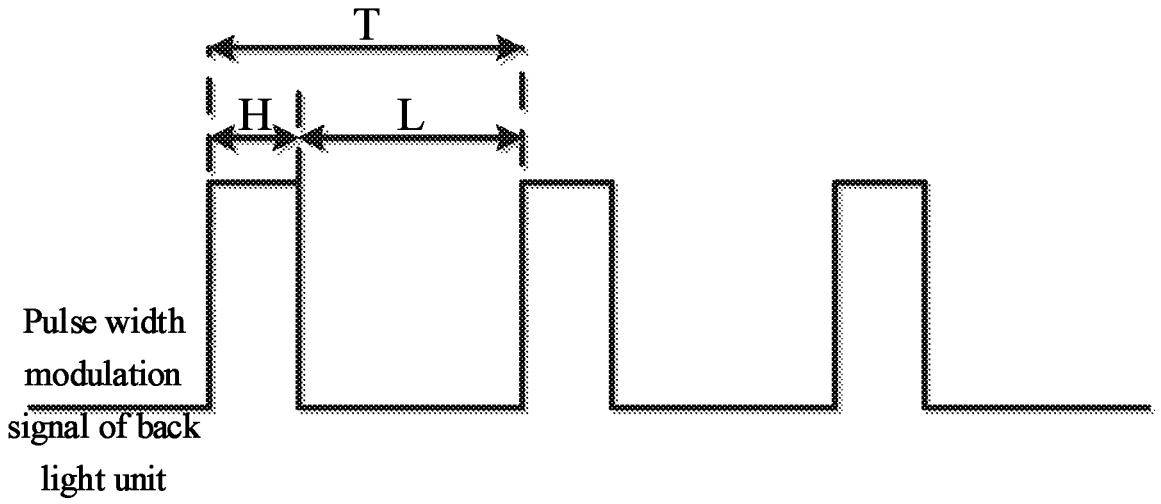
FIG. 1 is a schematic diagram of adjusting the brightness of a BLU through a pulse width modulation signal.

In the case that PWM is used to adjust the backlight brightness, when the brightness of the BLU is adjusted by changing the output duty ratio under certain frequency conditions. As shown in FIG. 1, which is a schematic diagram of adjusting the BLU by PWM, the PWM period of the backlight is T, the high level time is H in a cycle, and the BLU is in the backlight bright state at the moment; the low level time is L in a cycle, and the BLU is in the backlight dark state at the moment. Due to the high frequency, the human eyes cannot recognize switching between brightness and darkness, and can only perceive the overall brightness. Therefore, when the backlight brightness is changed by adjusting the duty ratio of high and low levels, the greater the proportion of the high level is, the higher the overall brightness is, and conversely, the smaller the proportion of the high level is, the lower the overall brightness is.

Figure 2:
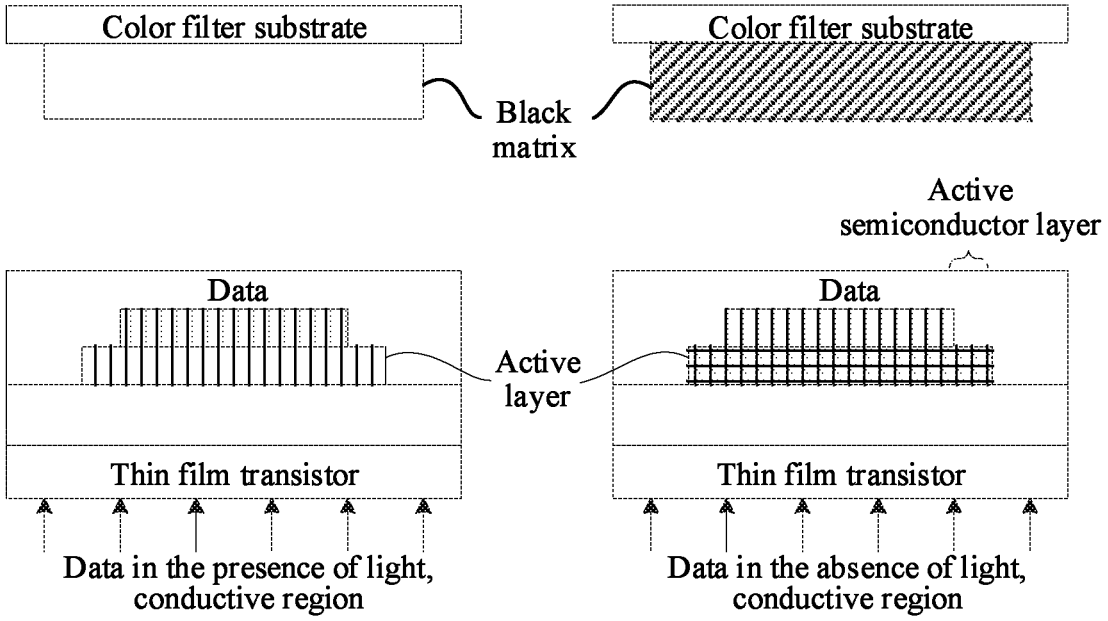
FIG. 2 is a schematic diagram of the influence of light on an array active layer.

When in the backlight bright state, light generates influence on the conductor characteristics of the array active layer. As shown in FIG. 2, the active layer under a data line has conductor characteristics under light, resulting in serious data delay, so that difference with the case of no light is generated, and the difference value is related to the size of active tail, wherein active tail is used to indicate the part, that exceeds the data line, of the active layer.

Figure 3:
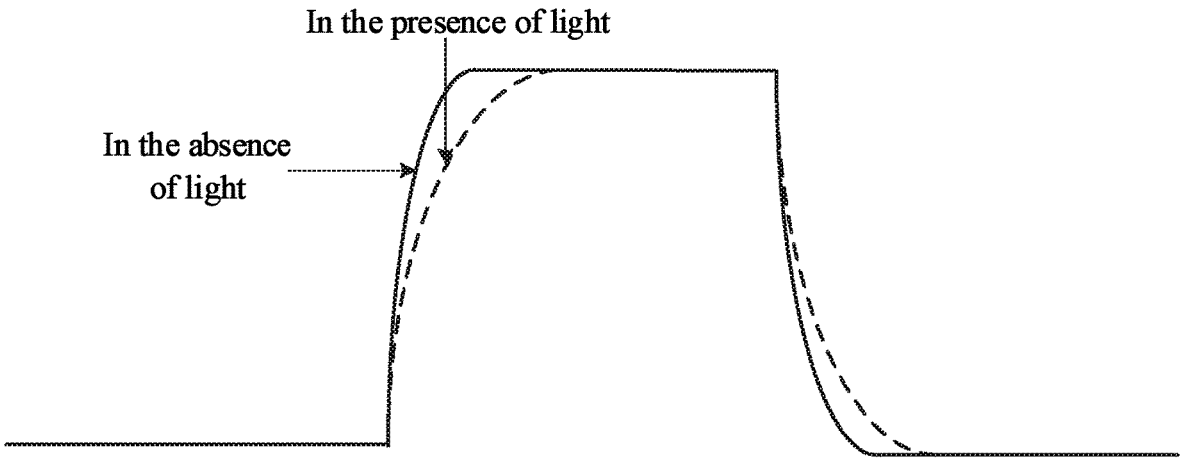
FIG. 3 is a schematic diagram of the data delay in the presence and absence of light for the BLU.
Figure 4:
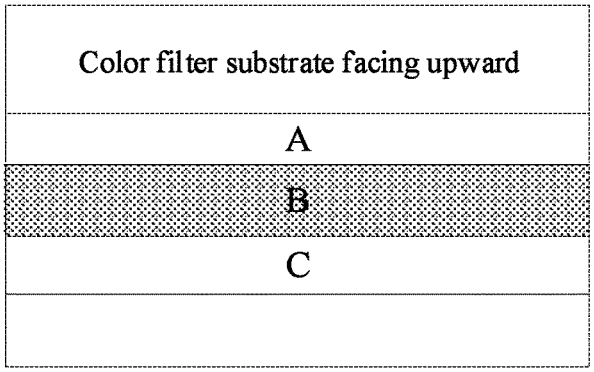
FIG. 4 is a schematic diagram that a liquid crystal display panel generates fringes with different brightness.

FIG. 3 is a schematic diagram of the data delay in the presence and absence of light for the BLU in the related art. It can be seen from FIG. 3 that the data delay is little, the charging rate is sufficient, the pixel voltage is high, and the brightness of the display panel is high when there is no light; but under the same data voltage, the data delay is serious in the presence of light, the charging rate is insufficient compared with the case of no light, the pixel voltage is low, and the brightness of the display panel is low, so that fringes with different brightness will be generated in the presence and absence of light. As shown in FIG. 4, region A and region C on the liquid crystal display panel are bright, and the pixel voltages in region A and region C are in high level states; while region B is dark, and the pixel voltage in this area is in a low level state.

It can be seen based on the above contents that at present, when the brightness of the BLU is controlled only by adjusting the duty ratio, data delays have difference due to the influence of light on the array active layer, resulting in that fringes with different brightness are generated on the display panel, which affects the display effect.

Aiming at the problem that the display effect is affected as the display panel generates fringes with different brightness in the presence and absence of light at present, the embodiments of present application provides a driving circuit for a liquid crystal display panel, which includes a signal collector, a memory chip, a timing control chip and a gate driving circuit.

The signal collector is configured to collect the backlight control signal. When determining that the BLU is in the bright state time period according to the backlight control signal, the timing control chip reads a first gate control signal from the memory chip for storing the first gate control signal corresponding to the bright state time period, and outputs the first gate control signal to the gate driving circuit. Similarly, when determining that the BLU is in the dark state time period according to the backlight control signal, the timing chip reads a second gate control signal from the memory chip for storing the second gate control signal corresponding to the dark state time period, and sends the second gate control signal to the gate driving circuit, to enable the driving circuit to control the pixels in the liquid crystal display panel to be charged according to the first gate control signal or the second gate control signal; wherein the charging durations are determined by the control signals, the first gate control signal corresponds to the first duration, the second gate control signal corresponds to a second duration, and the second duration is shorter than the first duration. The charging duration of the pixels in the liquid crystal display panel when the BLU is in the bright state time period is longer than the charging duration of the pixels in the liquid crystal display panel when the BLU is in the dark state time period, thus ensuring that the charging rates when the BLU is in the bright state time period and in the dark state time period are uniform, further realizing brightness uniformity of the displayed image in the liquid crystal display panel, and improving the display effect.

Figure 5:
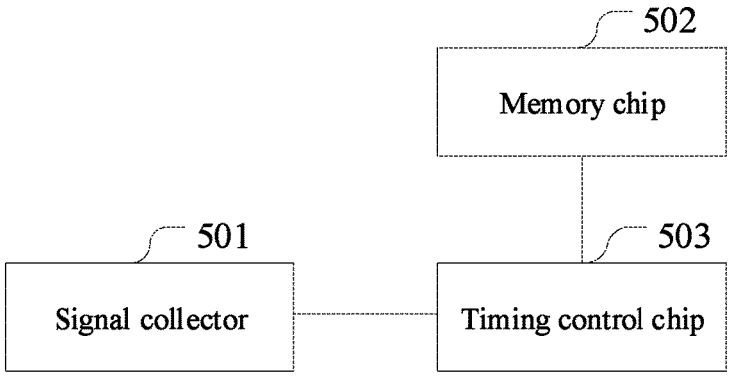
FIG. 5 is a structure diagram of a driving circuit for a liquid crystal display panel according to an embodiment of the present disclosure.

FIG. 5 is a structure diagram of a driving circuit for a liquid crystal display panel according to an embodiment of the present disclosure.

In the embodiments of present application, the driving circuit for the liquid crystal display panel includes a signal collector 501, a memory chip 502 and a timing control chip 503, wherein the signal collector 501 is connected to the timing control chip 503, and the timing control chip 503 is connected to the memory chip 502.

In the embodiments of present application, the signal collector 501 is configured to collect a backlight control signal.

The signal collector 501 is configured to collect the backlight control signal, mainly the PWM signal, convert the valid pulse signal of the PWM signal into a high level signal, and convert the invalid pulse signal of the PWM signal into a low level signal; wherein the high level signal indicates that the BLU is in the bright state time period, and the low level signal indicates that the BLU is in the dark state time period.

In the embodiments of present application, it is also possible to detect whether the BLU is in the bright state time period or in the dark state time period by virtue of a sensor, and any method that can determine whether the BLU is in the bright state time period or in the dark state time period is applicable to the present application, which will not be repeated here.

The signal collector 501 transmits the determined high level signal and the determined low level signal to the timing control chip 503.

When receiving the high level signal transmitted by the signal collector 501, the timing control chip 503 determines that the BLU is in the bright state time period, and retrieves the first gate control signal stored in the storage chip 502 and corresponding to the bright state time period. Similarly, when receiving the low level signal transmitted by the signal collector 501, the timing control chip 503 determines that the BLU is in the dark state time period, and retrieves the second gate control signal stored in the memory chip 502 and corresponding to the dark state time period.

When the timing control chip 503 retrieves the gate control signals stored in the memory chip 502, at least one register inside the timing control chip 503 retrieves the gate control signal stored in the memory chip 502 and corresponding to the high level signal or the low level signal according to the received high level signal or the received low level signal.

Figure 6:
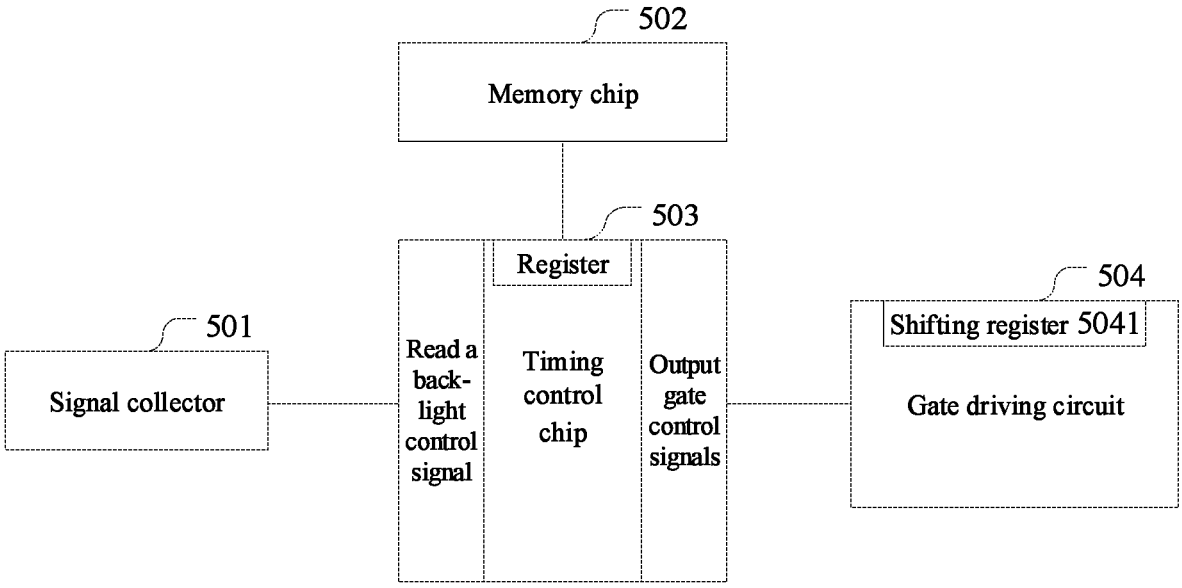
FIG. 6 is a structure diagram of another driving circuit for a liquid crystal display panel according to an embodiment of the present disclosure.

In the embodiments of present application, the driving circuit for the liquid crystal display panel further includes the gate driving circuit 504, which includes a plurality of cascaded shifting registers 5041, as shown in FIG. 6.

After reading the first gate control signal, the timing control chip 503 outputs the first gate control signal to the gate driving circuit 504, to enable the gate driving circuit 504 to control pixels in the liquid crystal display panel to be charged for a first duration according to the first gate control signal. Similarly, after reading the second gate control signal, the timing control chip 503 outputs the second gate control signal to the gate driving circuit 504, to enable the gate driving circuit 504 to control pixels in the liquid crystal display panel to be charged for a second duration according to the second gate control signal, wherein the second duration is shorter than the first duration.

Therefore, the gate driving circuit 504 is connected to the timing control chip 503, and the gate driving circuit 504 outputs a first gate scanning signal when receiving the first gate control signal transmitted by the timing control chip 503. Similarly, the gate driving circuit 504 outputs a second gate scanning signal when receiving the second gate control signal transmitted by the timing control chip 503.

Figure 7:
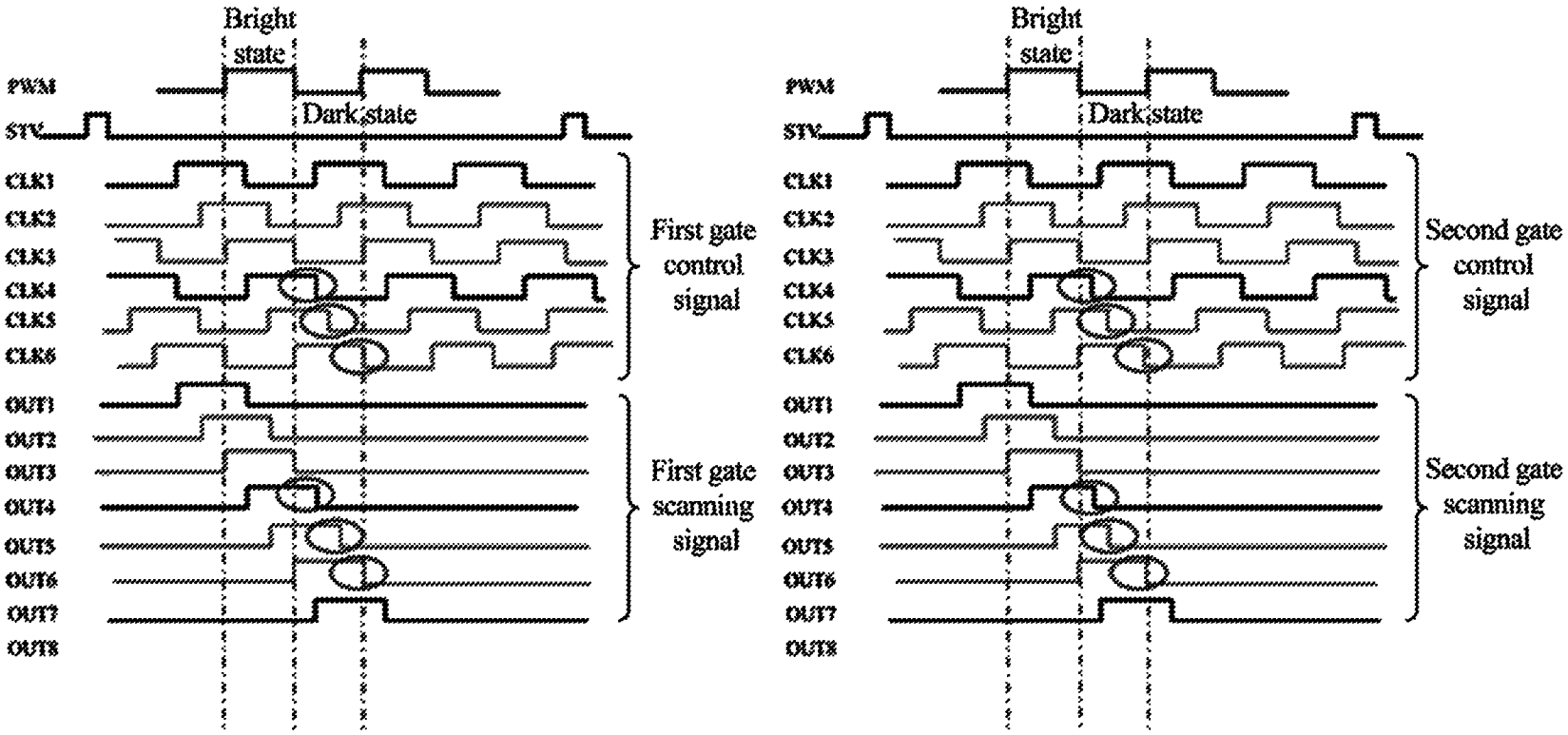
FIG. 7 is a schematic diagram of two sets of clock signals stored in a memory chip according to an embodiment of the present disclosure.

In the embodiments of present application, two sets of clock signals are stored in the memory chip 502, the first set of clock signals is the first gate control signal when the BLU is in the bright state time period, and the second set of clock signals is the second gate control signal when the BLU is in the dark state time period. Taking FIG. 7 as an example, as shown in FIG. 7, two sets of clock signals are stored in the memory chip 502, one set of clock signals is the unadjusted clock signals, and the other set of clock signals is the adjusted clock signals. It can be seen from FIG. 7 that the first set of clock signals and the second set of clock signals correspond to the same PWM signal, and the signal period durations of the first set of clock signals and the second set of clock signals are the same as the signal period duration of the PWM signal, so that the signal cycle duration of the first set of clock signals is the same as the signal cycle duration of the second set of clock signals. In addition, it can be seen from FIG. 7 that in a signal cycle, the valid pulse duration of the first set of clock signals is longer than the valid pulse duration of the second set of clock signals, specifically, such as clock signals CLK4, CLK5 and CLK6 in FIG. 7. Specifically, when the clock signals are used to control the charging time of the pixels, the charging duration when the BLU is in the dark state time period needs to be shortened, so that a way of advancing a falling edge is used to control the valid pulse duration, corresponding to the dark state time period, in the first set of clock signals to be longer than the valid pulse duration, corresponding to the dark state time period, in the second set of clock signals. Specifically, in the parts, in the same signal period as the backlight control signal, of the first set of clock signals and the second set of clock signals, the falling edge of the first set of clock signals occurs behind the falling edge of the second set of clock signals, and finally, the second duration is shorter than the first duration.

The driving circuit for the liquid crystal display panel in the embodiments of present application will be described below in conjunction with specific embodiments.

The first set of clock signals is output when it is determined that the BLU is in the bright state time period, and the second set of clock signals is output when it is determined that the BLU is in the dark state time period, which are illustrated in combination with the schematic diagram of the two types of clock signals stored in the memory chip (FIG. 7). When the BLU is in the bright state time period, the time sequence of CLK1, CLK2 and CLK3 in the first set of clock signals is used; and when the BLU is in the dark state time period, the time sequence of CLK4, CLK5, and CLK6 in the second set of clock signals is used. It can be seen from FIG. 7 that the falling edge time of the time sequence of CLK4, CLK5 and CLK6 in the second set of clock signals is earlier than that of the time sequence of CLK4, CLK5 and CLK6 in the first set of clock signals. OUT4, OUT5 and OUT6 are adjusted and controlled by CLK4, CLK5 and CLK6 respectively, so that the charging time of OUT4, OUT5 and OUT6 is reduced, and the charging rate when the BLU is in the dark state time period is reduced.

Figure 8:
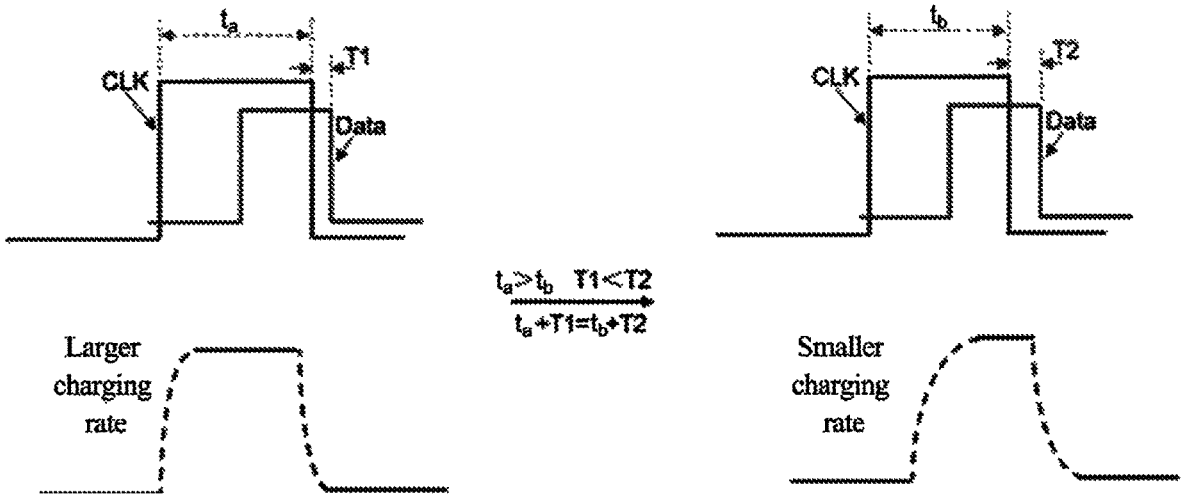
FIG. 8 is a schematic diagram of reducing a charging rate when the BLU is in the dark state time period according to an embodiment of the present disclosure.

A method for reducing the charging rate when the BLU is in the dark state time period is shown in FIG. 8, in which a represents a schematic diagram before adjustment of CLK, a1 represents a schematic diagram of the charging rate before adjustment of CLK, b represents a schematic diagram after adjustment of CLK, and b1 represents a schematic diagram of the charging rate after adjustment of CLK. It can be seen from the FIG. 8 that the rising edge time of CLK is unchanged, and the falling edge time is advanced. At this time, the charging time changes from ta to tb, ta>tb, the charging time becomes shorter. The charging rate is reduced when the data voltage is unchanged, so that the charging rates when the BLU is in the bright state time period and in the dark state time period are the same in the case that the charging rate when the BLU is in the dark state time period becomes smaller and the charging rate when the BLU is in the bright state time period is unchanged.

It should be noted that it is also possible to use the method of increasing the charging rate when the BLU is in the bright state time period and ensuring that the charging rate when the BLU is in the dark state time period is unchanged, as long as the charging rate when the BLU is in the dark state time period is the same as the charging rate when the BLU is in the bright state time period. Therefore, the solutions for adjusting positions of the rising edges and/or falling edges of the clock signals to achieve the same charging rate when the BLU is in the dark state time period and in the bright state time period are all applicable to the present application, which will not be repeated here.

Therefore, according to the driving circuit for the liquid crystal display panel in the embodiments of present application, the first gate control signal is selected when the BLU is in the bright state time period, and the gate driving circuit controls pixels in the liquid crystal display panel to be charged for a first duration according to the first gate control signal; and the second gate control signal is selected when the BLU is in the dark state time period, and the gate driving circuit controls pixels in the liquid crystal display panel to be charged for a second duration according to the second gate control signal, wherein the second duration is shorter than the first duration. Therefore, the charging time of the pixels when the BLU is in the dark state time period is shorter than the charging time of the pixels when the BLU is in the bright state time period. The charging rate when the BLU is in the bright state time period is less than the charging rate when the BLU is in the dark state time period in the same charging time, resulting in different pixel voltages when the BLU is in the bright state time period and in the dark state time period, and appearance of fringes with different brightness. The present embodiments of application improves the charging rates when the BLU is in the bright state time period and in the dark state time period by changing the charging time when the BLU is in the bright state time period and in the dark state time period, so that the charging rates when the BLU is in the bright state time period and in the dark state time period are the same, the display brightness of the liquid crystal display panel is uniform, the appearance of fringes with different brightness is avoided, and the display effect of the display panel is improved.

The embodiments of present application further provides a display device, including a liquid crystal display panel, a BLU, and the driving circuit for the liquid crystal display panel according to the embodiments of present application. The driving circuit includes a gate drive circuit, which is integrated in the liquid crystal display panel.

Figure 9:
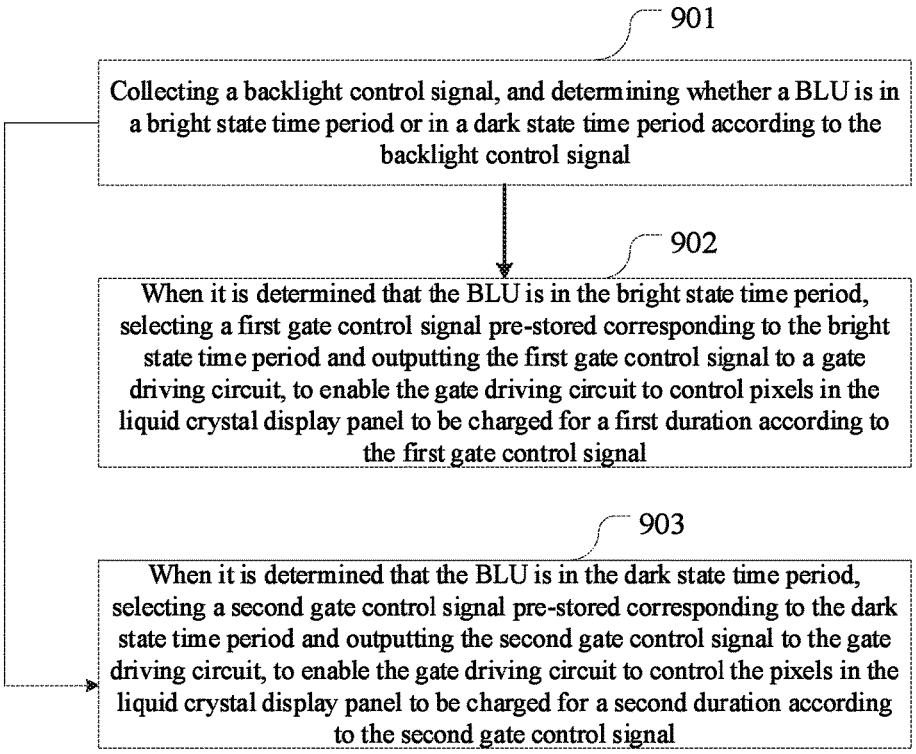
FIG. 9 is a flowchart of a driving method for a liquid crystal display panel according to an embodiment of the present disclosure.

The embodiments of present application further provides a driving method for a liquid crystal display panel, and as shown in FIG. 9, the driving method for the liquid crystal display panel according to the embodiments of present application includes the following steps.

Step 901, collecting a backlight control signal, and determining whether a BLU is in a bright state time period or in a dark state time period according to the backlight control signal.

In the embodiments of present application, the collected backlight control signal is the PWM signal obtained by the signal collector. When whether the BLU is in the bright state time period or in the dark state time period is determined according to the backlight control signal, the PWM signal is converted into the high level signal or the low level signal, and whether the BLU is in the bright state time period or in the dark state time period is determined according to the converted high level signal or the converted low level signal.

In the case that the PWM signal is converted into the high level signal or the low level signal, when a valid pulse signal is converted into a high level signal and it is determined that the high level signal is received, the BLU is in the bright state time period; and when an invalid pulse signal is converted into a low level signal and it is determined that the low level signal is received, the BLU is in the dark state time period.

In the embodiments of present application, it is also possible to detect whether the BLU is in the bright state time period or in the dark state time period by virtue of a sensor, and any method that can determine whether the BLU is in the bright state time period or in the dark state time period is applicable to the present application, which will not be repeated here.

Step 902, when it is determined that the BLU is in the bright state time period, selecting a first gate control signal pre-stored corresponding to the bright state time period and outputting the first gate control signal to a gate driving circuit, to enable the gate driving circuit to control pixels in the liquid crystal display panel to be charged for a first duration according to the first gate control signal.

Step 903, when it is determined that the BLU is in the dark state time period, selecting a second gate control signal pre-stored corresponding to the dark state time period and outputting the second gate control signal to the gate driving circuit, to enable the gate driving circuit to control the pixels in the liquid crystal display panel to be charged for a second duration according to the second gate control signal.

In the embodiments of present application, the first gate control signal includes the first set of clock signals, the second gate control signal includes the second set of clock signals, and the signal cycle duration of the first set of clock signals is the same as the signal cycle duration of the second set of clock signals; and in parts, in the same signal cycle as the backlight control signal, of the first set of clock signals and the second set of clock signals, the falling edge of the first set of clock signals occurs behind the falling edge of the second set of clock signals. Therefore, in a signal cycle, the valid pulse duration of the first set of clock signals is longer than the valid pulse duration of the second set of clock signals; and finally, the first duration is longer than the second duration.

In the embodiments of present application, the two types of clock signals stored in the memory chip are pre-stored after calculation according to the proportional relationship that the charging rates are different when the BLU in the bright state time period and in the dark state time period, so as to ensure that the charging rates are the same when the BLU is in the bright state time period and in the dark state time period.

In the above driving method for the display panel in the embodiments of present application, whether the BLU is in the bright state time period or in the dark state time period is determined according to the collected backlight control signal, the first gate control signal is selected when it is determined that the BLU is in the bright state time period, the second gate control signal is selected when it is determined that BLU is in the dark state time period, and the first gate control signal and the second gate control signal are output to the gate driving circuit, so that the gate driving circuit controls the liquid crystal display panel to be charged for the first duration according to the first gate control signal, and controls the liquid crystal display panel to be charged for the second duration according to the second gate control signal, wherein the second duration is shorter than first duration. By changing the charging duration of the liquid crystal display panel when the BLU is in the bright state time period or in the dark state time period, it is ensured that the charging rates are the same when the BLU is in the bright state time period and in the dark state time period, brightness uniformity of a displayed image is achieved, appearance of fringes with different brightness in the liquid crystal display panel is avoided, and the display effect is improved.

Although the preferred embodiments of the present application have been described, those skilled in the art can make other changes and modifications to these embodiments once they learn the basic inventive concept. Therefore, the appended claims are intended to be construed as including the preferred embodiments and all changes and modifications falling within the scope of the present application.

Obviously, those skilled in the art can make various modifications and variations to the present application without departing from the spirit and scope of the present application. In this way, if these modifications and variations of the present application fall within the scope of the claims of the present application and their equivalent technologies, the present application is also intended to include these modifications and variations.

What is claimed is:

1. A driving circuit for a liquid crystal display panel, comprising:

a signal collector, configured to collect a backlight control signal;

a memory chip, configured to store a first gate control signal and a second gate control signal; and a timing control chip, configured to:

determine whether a back light unit (BLU) is in a bright state time period or in a dark state time period according to the backlight control signal; and when determining that the BLU is in the bright state time period, retrieve the first gate control signal stored in the memory chip, and output the first gate control signal to a gate driving circuit, for controlling pixels in the liquid crystal display panel to be charged for a first duration according to the first gate control signal;

when determining that the BLU is in the dark state time period, retrieve the second gate control signal stored in the memory chip, and output the second gate control signal to the gate driving circuit, for controlling the pixels in the liquid crystal display panel to be charged for a second duration according to the second gate control signal;

wherein the second duration is shorter than the first duration.

2. The driving circuit according to claim 1, wherein the signal collector is configured to:

convert a valid pulse signal, for controlling the BLU to be in a bright state, in the backlight control signal into a high level signal; and convert an invalid pulse signal, for controlling the BLU to be in a dark state, in the backlight control signal into a low level signal;

the timing control chip is configured to:

retrieve a part, corresponding to the high level signal, in the first gate control signal stored in the memory chip when it is determined that the high level signal transmitted by the signal collector is received; and retrieve a part, corresponding to the low level signal, in the second gate control signal stored in the memory chip when it is determined that the low level signal transmitted by the signal collector is received.

3. The driving circuit according to claim 2, wherein the first gate control signal comprises a first set of clock signals, and the second gate control signal comprises a second set of clock signals;

a signal cycle duration of the first set of clock signals is the same as a signal cycle duration of the second set of clock signals; and in a signal cycle, a valid pulse duration of the first set of clock signals is longer than a valid pulse duration of the second set of clock signals.

4. The driving circuit according to claim 3, wherein in parts, in the same signal cycle as the backlight control signal, of the first set of clock signals and the second set of clock signals, a falling edge of the first set of clock signals occurs behind a falling edge of the second set of clock signals.

5. The driving circuit according to claim 1, further comprising the gate driving circuit, wherein the gate driving circuit comprises a plurality of cascaded shifting registers, the shifting registers are configured to output a first gate scanning signal when receiving the first gate control signal, and output a second gate scanning signal when receiving the second gate control signal; and a valid pulse duration of the first gate scanning signal is longer than a valid pulse duration of the second gate scanning signal.

6. A display device, comprising the liquid crystal display panel, the BLU, and the driving circuit according to claim 1.

7. The display device according to claim 6, wherein the gate driving circuit in the driving circuit is integrated in the liquid crystal display panel.

8. A driving method for a liquid crystal display panel, comprising:

collecting a backlight control signal;

determining whether a back light unit (BLU) is in a bright state time period or in a dark state time period according to the backlight control signal; and when it is determined that the BLU is in the bright state time period, selecting a first gate control signal pre-stored corresponding to the bright state time period and outputting the first gate control signal to a gate driving circuit, for controlling pixels in the liquid crystal display panel to be charged for a first duration according to the first gate control signal;

when it is determined that the BLU is in the dark state time period, selecting a second gate control signal pre-stored corresponding to the dark state time period and outputting the second gate control signal to the gate driving circuit, for controlling the pixels in the liquid crystal display panel to be charged for a second duration according to the second gate control signal, wherein the second duration is shorter than the first duration.

9. The driving method according to claim 8, wherein after collecting the backlight control signal, the driving method further comprises:

converting a valid pulse signal in the backlight control signal into a high level signal, and converting an invalid pulse signal in the backlight control signal into a low level signal;

wherein said determining whether the BLU is in the bright state time period or in the dark state time period according to the backlight control signal comprises:

when determining that the high level signal is received, determining that the BLU is in the bright state time period;

when determining that the low level signal is received, determining that the BLU is in the dark state time period.

10. The driving method according to claim 8, wherein the first gate control signal includes a first set of clock signals, and the second gate control signal includes a second set of clock signals;

a signal cycle duration of the first set of clock signals is the same as a signal cycle duration of the second set of clock signals; and in a signal cycle, a valid pulse duration of the first set of clock signals is longer than a valid pulse duration of the second set of clock signals.

* * * * *